US007165279B1

(12) United States Patent
Georgescu

(10) Patent No.: US 7,165,279 B1
(45) Date of Patent: Jan. 23, 2007

(54) FACIAL BEAUTY PILLOW

(76) Inventor: Daniela Georgescu, 9334 Sable Ridge Cir., Apt. B, Boca Raton, FL (US) 33428-1447

( * ) Notice: Subject to any disclaimer, the term of this patent is extended or adjusted under 35 U.S.C. 154(b) by 0 days.

(21) Appl. No.: 11/284,742

(22) Filed: Nov. 22, 2005

(51) Int. Cl.
*A47G 9/00* (2006.01)

(52) U.S. Cl. ..... 5/636; 5/490

(58) Field of Classification Search ..... 5/636, 5/640, 490; 297/397; D6/601
See application file for complete search history.

(56) References Cited

U.S. PATENT DOCUMENTS 2,295,906 A * 9/1942 Lacour ..... 5/636
4,118,813 A * 10/1978 Armstrong ..... 5/638
4,471,993 A * 9/1984 Watson ..... 297/284.5
5,528,784 A * 6/1996 Painter ..... 5/640
D388,648 S * 1/1998 Bates ..... D6/601
D410,810 S * 6/1999 Lozier ..... D6/601
6,748,615 B1 * 6/2004 Tiedemann ..... 5/640
6,915,539 B1 * 7/2005 Rathbun ..... 5/636
6,957,462 B1 * 10/2005 Wilcox ..... 5/636

* cited by examiner

*Primary Examiner*—Alexander Grosz
(74) *Attorney, Agent, or Firm*—Robert M. Downey, PA

(57) ABSTRACT

A pillow is structured for preserving a user's facial beauty and includes a central portion, and upper and lower leg members extending from both the left and right sides of the central portion. The upper and lower leg members on each side are angled relative to one another to form a V-shaped gap. The upper and lower leg members support the user's head and neck, while the face remains over the V-shaped gap avoiding contact with the pillow, and thereby preventing distortion and wrinkling of the facial skin. A case that covers the facial beauty pillow may include straps, allowing the facial beauty pillow to be secured to a conventional pillow to adjust the resting height of the head according to the individual comfort level of the user.

4 Claims, 2 Drawing Sheets

FACIAL BEAUTY PILLOW

BACKGROUND OF THE INVENTION

1. Field of the Invention

The present invention relates to pillows, and more particularly to a beauty preservation pillow that is structured to comfortably support the user's head and neck while avoiding contact with the facial skin when the user's head is turned to either side.

2. Discussion of the Related Art

Preserving facial beauty is extremely important to people of many cultures throughout the world. In the US alone, Americans spend billions of dollars each year in order to maintain or improve their facial appearance. In addition to a vest array of cosmetic products, procedures such as BOTOX injections and plastic surgery have become common place in today's society. Millions of people want to look younger and, in most cases, eliminating wrinkles is their primary concern. Unfortunately, wrinkles are an inevitable result of aging and, while some people are less genetically disposed to wrinkle formation, no one is entirely immune from the effects of growing older.

Aside from aging, the formation of facial wrinkles, particularly on the forehead and around the eyes and mouth, is accelerated as a result of poor skin maintenance and bad habits. In particular, exposure of the facial skin to the sun's ultraviolet rays will cause premature aging and wrinkling of the skin. Also, temporary facial distortions as a result of expressions, such as frowning, and application of external pressure to the skin can contribute to undesirable wrinkle formation. In particular, resting one's face against a pillow causes the facial skin to be compressed and distorted from its natural state. And, considering that most people spend about one third of their life sleeping with their face on a pillow, the prolonged and repeated distortion of the facial skin will eventually result in premature wrinkle formation.

In light of the desire of many people to preserve facial beauty and avoid premature wrinkles, particularly as a result of unnecessary facial distortion, there remains a definite and urgent need for a pillow that is structured to comfortably support the head and neck without contacting the user's face so that the facial skin remains relaxed and in it's natural state.

SUMMARY OF THE INVENTION

The present invention is directed to a pillow that is structured for preserving a user's facial beauty and includes a central portion, as well as upper and lower leg members extending from both the left and right sides of the central portion. The upper and lower leg members on each side are angled relative to one another to form a V-shaped gap. The upper and lower leg members support the user's head and neck, while the face remains over the V-shaped gap avoiding contact with the pillow, and thereby preventing distortion and wrinkling of the facial skin. A case that covers the facial beauty pillow may include straps, allowing the facial beauty pillow to be secured to a conventional pillow to adjust the resting height of the head according to the individual comfort level of the user.

OBJECTS OF THE INVENTION

Considering the foregoing, it is a primary object of the present invention to provide a pillow that allows a person to comfortably rest their head while sleeping or laying down, and wherein the pillow is designed to support the person's head and neck without touching the face so that the facial skin is not wrinkled.

It is a further object of the present invention to provide a facial beauty pillow that allows a person to rest their head to either side of the pillow without the pillow touching or wrinkling their facial skin.

It is still a further object of the present invention to provide a pillow that helps to preserve the user's natural beauty by avoiding distortion and wrinkling of the facial skin while resting and sleeping.

It is yet a further object of the present invention to provide a facial beauty pillow, as set forth above, which can be used in conjunction with a conventional pillow to suit the individual user's comfort.

It is still a further object of the present invention to provide a facial beauty pillow that provides a novel and highly functional configuration in a simple, unitary construction.

It is still a further object of the present invention to provide a facial beauty pillow which is highly effective in preventing wrinkles, and yet is relatively inexpensive and affordable when compared to other available facial beauty products on the market.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
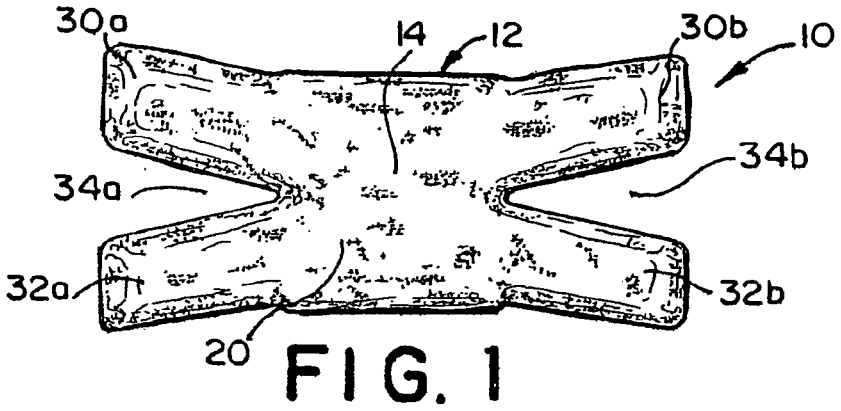
FIG. 1 is a top plan view of the facial beauty pillow of the present invention.
Figure 2:
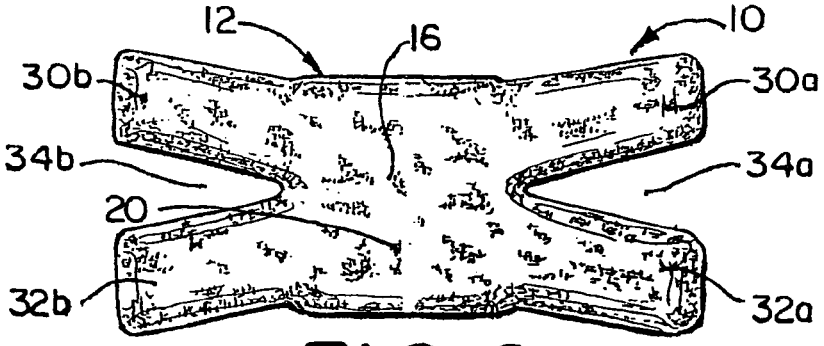
FIG. 2 is a bottom plan view thereof.
Figure 3:
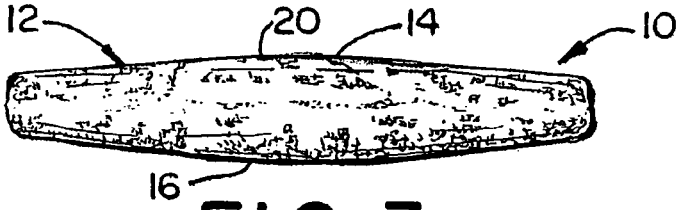
FIG. 3 is a front elevational view of the facial beauty pillow.
Figure 4:
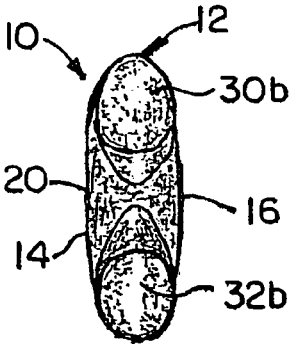
FIG. 4 is an end elevational view taken from FIG. 1.
Figure 5:
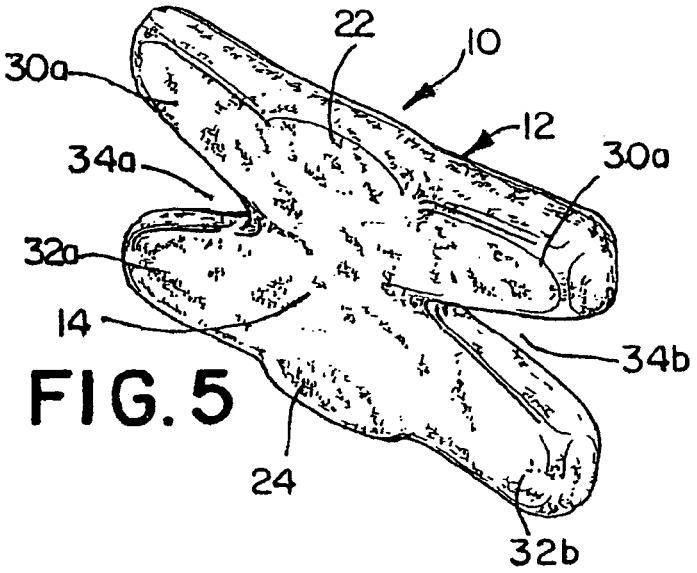
FIG. 5 is a top perspective view of the facial beauty pillow.
Figure 6:
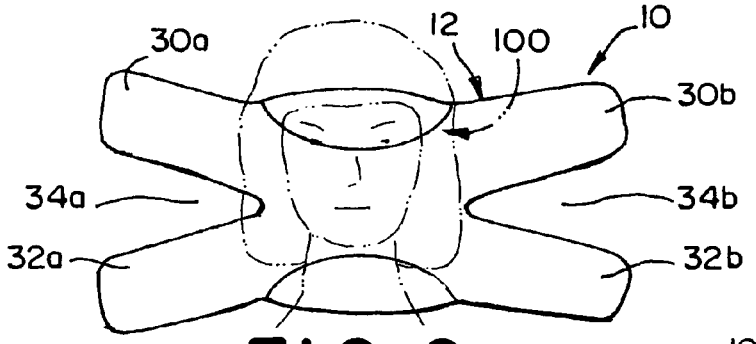
FIG. 6 is a top plan view, in diagram form, showing a user's head in a phantom lines, with the back of the user's head resting on a central portion of the pillow.

Referring to the several views of the drawings, and initially FIGS. 1–5, the facial beauty pillow of the present invention is shown and is generally indicated as 10. The pillow 10 includes a main body 12 with a top side 14 a bottom side 16. The pillow has a generally X-shaped configuration with a central portion 20 and four leg members extending outwardly from the central portion 20. The central portion 20 of the pillow 10 is particularly adapted to support the back of the user's head and neck when the user's head 100 is positioned as shown in FIG. 6. In a preferred embodiment, the central portion 20 includes a zone of increased cushion thickness along the top and bottom areas for added neck support.

Figure 7:
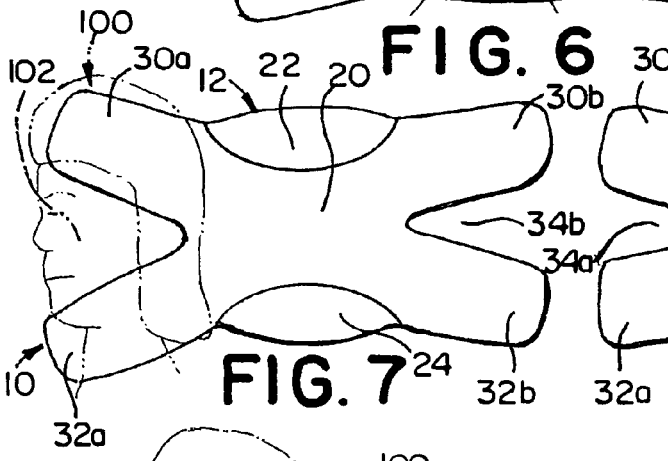
FIG. 7 is a top plan view, in general diagram form, showing the user's head in phantom lines, with the right side of the user's head resting against upper and lower left leg members of the pillow and with the user's facial skin remaining untouched.
Figure 8:
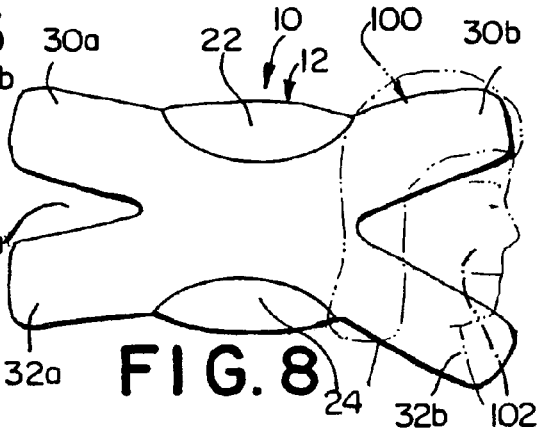
FIG. 8 is a top plan view, in general diagram form, showing the user's head in phantom lines, with the left of the user's head resting against upper and lower right leg members of the pillow and with the user's facial skin remaining untouched.

The leg members include upper leg members and lower leg members. More particularly, there is an upper left leg member 30*a* and a lower left leg member 32*a*. Likewise, the pillow 10 has an upper right leg member 30*b* and a lower right leg member 32*b*. A generally V-shaped gap is formed between the respective upper and lower leg members. Specifically, gap 34*a* is formed between left upper leg member 30*a* and left lower leg member 32*a*. Similarly, a gap 34*b* is formed between right upper leg member 30*b* and right lower leg member 32*b*. The V-shaped gaps are specifically structured and configured to avoid contact with the user's face 102 when the user rests his/her head 100 to either side of the pillow, as shown in FIGS. 7 and 8. For example, in FIG. 7 the user is resting her head 100 to the left side of the pillow 10, so that the right side of the user's head faces down towards the pillow In this example, the upper portion of the user's head is resting on the left upper leg member 30*a* and the user's lower chin and neck are resting on the left lower leg member 32*a*, while the user's face 102 is untouched by the pillow 10 or any other object so that the facial skin remains in it's natural, relaxed state without being distorted and/or wrinkled.

FIG. 8 shows a position of the user's head 100 when resting to the right side of the pillow 10 so that the left side of the user's head faces down towards the pillow 10. Specifically, the right upper leg member 30*b* engages the top left side of the user's head while the right lower leg member 32*b* supports the user's lower chin and neck of the left side of the user's head. Similar to FIG. 7, the user's face 102 remains untouched by the pillow 10 or any other objects to prevent distortion and wrinkling of the facial skin.

Figure 9:
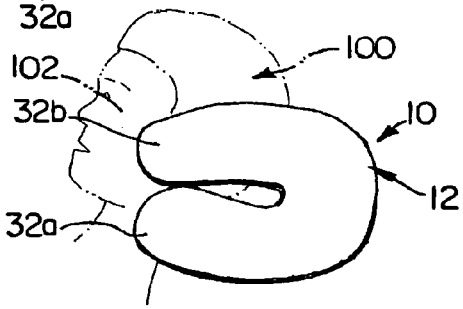
FIG. 9 is a side elevational view illustrating a further position of use of the pillow.

FIG. 9 illustrates an alternative positioning of the pillow 10, wherein the pillow 10 is folded in half and tucked behind the user's head and neck to comfortably support the user's head 100 in a propped-up position. This is particularly useful when reading or watching television in bed. As seen in FIG. 9, the pillow 10 is folded so that the right side leg members overlap the left side leg members.

Figure 10:
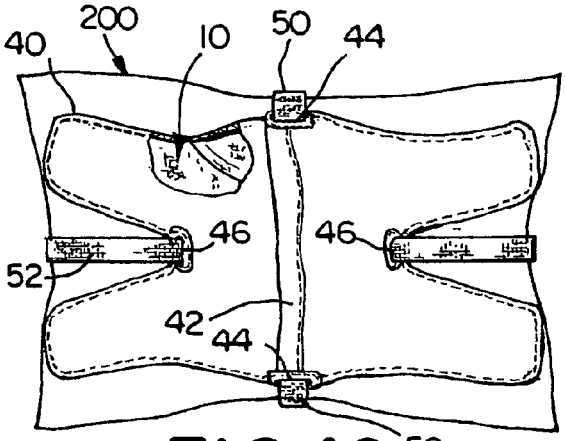
FIG. 10 is a top plan view showing the facial beauty pillow of the present invention securely strapped to a conventional pillow.
Figure 11:
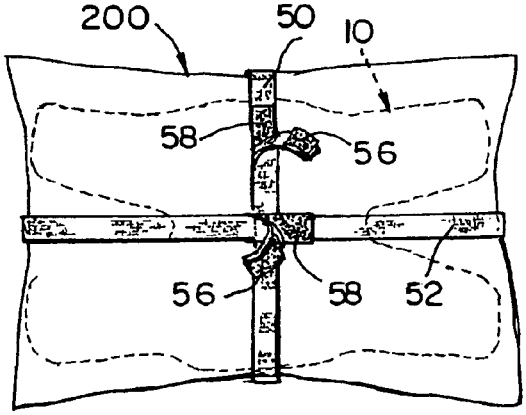
FIG. 11 is a bottom plan view, showing an underside of the conventional pillow, with the facial beauty pillow securely strap thereto.

FIGS. 10 and 11 illustrate a further use of the facial beauty pillow 10. Specifically, the facial beauty pillow 10 is strapped to a conventional pillow 200. In this instance, a case 40 is fitted over the facial beauty pillow 10 by inserting the pillow 10 through a central access opening 42 defined by an overlapping flap extending from the top to the bottom of the pillowcase 40. The pillowcase 40 is provided with slot openings 44 for passage of a strap 50 therethrough. The pillowcase 40 may also be provided with additional slots 46 for passage of a second strap 52 therethrough. The straps 50 and 52 are intended to be wrapped about the conventional pillow 200 and secured in place with correspondingly positioned hook and loop fasteners 56, 58. This allows the facial beauty pillow 10 to be securely strapped to a conventional pillow 200 so that the user can still have the benefit of the facial beauty pillow 10 while also using the conventional pillow 200 for added comfort.

While the present invention has been shown and described in accordance with a preferred and practical embodiment, it is recognized that departures from the instant disclosure are contemplated within the spirit and scope of the present invention which is not to be limited except as defined in the accompanying claims, as interpreted under the doctrine of equivalence.

What is claimed is:

1. A pillow for promoting facial beauty of a user, said pillow comprising:

a main pillow body having an X-shaped configuration and including a central portion sized and configured to support the back of the user's head and a plurality of leg members extending outwardly from said central portion, said plurality of leg members including:

a left pair of leg members extending from a left side of said central portion;

a right pair of leg members extending from a right side of said central portion;

said left and right pairs of leg members including an upper leg member and a lower leg member, and said left and right pairs of leg members being arranged and configured to form a V-shaped gap between said upper and lower leg members with said upper and lower leg members extending from said central portion and continually diverging from one another on opposite upper and lower sides of said V-shaped gap; and said leg member pairs being structured and disposed to support the user's head with said upper leg member extending from behind the user's ear and along the user's hair line and said lower leg member extending from behind the user's ear and along the user's jaw bone and neck and with the user's facial skin positioned over the V-shaped gap and free from contact with the pillow.

2. The pillow as recited in claim 1 further including an area of increased cushion thickness on said central portion for supporting the neck of the user.

3. The pillow as recited in claim 1 further comprising a pillowcase for covering said pillow, and said pillowcase including at least one strap for securing said pillow to another object.

4. The pillow as recited in claim 3 wherein said pillowcase includes a plurality of straps.

* * * * *